US006033550A

United States Patent [19]

Bonnardel et al.

[11] Patent Number: 6,033,550

[45] Date of Patent: Mar. 7, 2000

[54] PROCESS FOR CONTROLLING THE ALUMINA CONTENT OF THE BATH IN ELECTROLYSIS CELLS FOR ALUMINUM PRODUCTION

[75] Inventors: Olivier Bonnardel, St Martin D'Arc; Pierre Marcellin, Bahrein, both of France

[73] Assignee: Aluminium Pechiney, Courbevoie, France

[21] Appl. No.: 08/876,335

[22] Filed: Jun. 17, 1997

[30] Foreign Application Priority Data

Jun. 17, 1996 [FR] France ..... 96 07712

[51] Int. Cl.[7] ..... C25C 3/20

[52] U.S. Cl. ..... 205/375; 205/392

[58] Field of Search ..... 205/375, 392

[56] References Cited

U.S. PATENT DOCUMENTS

| | | | |
|---|---|---|---|
| 4,425,201 | 1/1984 | Wilson | 205/392 X |
| 4,431,491 | 2/1984 | Bonny et al. | 205/392 X |
| 4,654,129 | 3/1987 | Leroy | 205/392 X |
| 4,654,130 | 3/1987 | Tabereaux et al. . | |
| 4,766,552 | 8/1988 | Aalbu et al. | 205/392 X |

FOREIGN PATENT DOCUMENTS

| | | |
|---|---|---|
| 0 671 488 | 9/1995 | European Pat. Off. . |
| WO 86/05008 | 8/1986 | WIPO . |

*Primary Examiner*—Donald R. Valentine

*Attorney, Agent, or Firm*—Oblon, Spivak, McClelland , Maier & Neustadt, P.C.

[57] ABSTRACT

A process for control of the alumina content of the bath in a cell for production of aluminum by electrolysis of alumina dissolved in a molten cryolite-base salt, consisting of alternation of phases of alumina underfeeding and phases of alumina overfeeding compared with a theoretical mean rate of alumina consumption of the cell, the said alternation being a function of values, calculated at the end of each control cycle i of duration T, of the mean resistance R(i) measured at the cell electrode terminals, of the rate of change of this resistance or resistance slope P(i), of the rate of change of the resistance slope or curvature C(i) and of the extrapolated slope PX(i)=P(i)+C(i)×T, these values being compared respectively with reference values Po, Co and PXo in order to modulate, according to an appropriate control algorithm, the alumina content of the bath in a very narrow concentration range between 1.5 and 3.5%.

24 Claims, 3 Drawing Sheets

PROCESS FOR CONTROLLING THE ALUMINA CONTENT OF THE BATH IN ELECTROLYSIS CELLS FOR ALUMINUM PRODUCTION

TECHNICAL FIELD

The present invention relates to a process for precise control of the alumina content in igneous electrolysis cells for aluminum production by the Hall-Heroult process, with a view not only to maintaining the Faraday efficiency at high level but also to reducing fluorocarbon gas emissions, which are particularly noxious and environmentally polluting, and which result from operating anomalies of electrolysis cells known as anode effect.

STATE OF THE ART

The operation of aluminum production cells has been progressively automated in recent years, primarily to improve process regularity and thus the energy balance and Faraday efficiency, but also—from the viewpoint of ergonomics and ecology—to limit laborious human actions and to increase the efficiency of capturing fluorine-containing effluents.

One of the main requirements for assuring process regularity of a cell for aluminum production by electrolysis of alumina dissolved in a molten cryolite-base electrolysis bath is that an appropriate dissolved alumina content be maintained in the electrolyte and thus that the rate at which alumina is added to the bath be at any time adapted to the rate of alumina consumption in the cell.

For example, excess alumina creates a risk of fouling of the cell bottom by undissolved alumina deposits, which can be transformed into hard coatings that electrically insulate part of the cathode. This then favors development of very strong horizontal electrical currents within the metal in the cells, which currents interact with the magnetic fields to stir up the metal layer and cause instability of the bath-metal interface.

Conversely, an alumina deficiency causes appearance of the anode effect, which is manifested by production loss and by abrupt rise in voltage at the cell electrode terminals, from 4 to 30 or 40 volts. This excessive energy consumption also has the effect of degrading not only the energy efficiency of the cell but also the Faraday efficiency following redissolution of aluminum in the bath and elevation of the electrolysis bath temperature.

The need to maintain the dissolved alumina content in the electrolyte within precise and relatively narrow limits and thus to add alumina with the maximum possible regularity has therefore led the person skilled in the art to develop automatic processes for feeding alumina to and controlling alumina in electrolysis cells. This need has become an obligation with the use of so-called "acid" electrolysis baths (high $AlF_3$ content), which permit the operating temperature of the cell to be lowered by 10 to 15° C. (around 950° C. instead of the usual 965° C.) and thus Faraday efficiencies of at least 94% to be achieved. In fact, it is then indispensable to be able to control the alumina content within a very precise and very narrow concentration range (1% to 3.5%), taking into account the decrease in alumina solubility ratio associated with the new composition and with the lowering of bath temperature.

Since direct measurement of the alumina content of baths by analysis of periodically removed samples has not proved sufficiently useful for industrial purposes, the majority of known industrial processes have resorted to indirect evaluation of the alumina contents by following an electrical parameter representative of the alumina concentration of the said electrolyte. This parameter is generally the variation of resistance R at the cell electrode terminals according to the equation R=(U-e) / I, where U is the cell supply voltage and e the back electromotive force, evaluated as 1.65 volt, for example, and I is the current passing through the cell. A curve of the variation of R as a function of alumina content can be plotted by calibration, and the alumina concentration $[Al_2O_3]$ can be known at any time by measuring R (at specified intervals by well known methods). This detection principle is used in FR 1,457,746 (GB 1,091,373) to send commands to an alumina feeder associated with a means for piercing the electrolyte crust formed at the bath surface. Similarly, U.S. Pat. No. 3,400,062 employs measurement of bath resistance variation by means of a pilot anode to detect any alumina deficiency and any tendency to the anode effect, and thus to adjust the rate of addition of alumina from a hopper provided with a device for piercing the electrolyte crust.

More recently, precise control processes based on maintaining the alumina content between upper and lower limits have been the object of numerous patents, including U.S. Pat. No. 4,126,525 and EP 044,794 (U.S. Pat. No. 4,431,491 ), the latter of which is already in the name of Applicant.

In the first of these patents, the range of alumina contents to be maintained is between 2 and 8%. The cell is fed with alumina for a predetermined time t1 at a rate higher than the theoretical rate of consumption thereof until a fixed alumina concentration (such as 7%, and therefore slightly below the maximum permissible value of 8%) is reached, then the feed rate is changed to a value equal to the theoretical consumption rate for a predetermined time t2, and finally the feed is stopped until the first symptoms of anode effect appear. The feed cycle is then resumed at a rate higher than the theoretical consumption rate. According to this process, and more precisely to the results of practical examples thereof, the alumina concentration of the bath may vary from 3 to 8% in the course of one cycle, and so the process is still inadequate as regards control of the alumina content of an acid bath in a range as low and narrow as 1 to 3 or 4%. This object is achieved by the process according to EP 044,794 (U.S. Pat. No. 4,431,491) in the name of Applicant, which process relies on a second control parameter involving measurement of the resistance R at the electrolysis cell electrode terminals, the said parameter being the slope P=dR/dt, which represents the variation of resistance R caused by an intentional change of the rate of alumina feed to the bath for a specified time. In fact, knowledge merely of the resistance R at the electrolysis cell electrode terminals is not sufficient for precise mastery of the alumina content of the bath and therefore for control over the quantity or frequency of anode effects, because at constant bath temperature the parameter R is a function of 2 variables, one being the alumina content, reflected by bath resistivity ρ, and the other being the anode-metal distance (AMD). Thus it is necessary to find another discriminant parameter, which is obtained by the slope P=dR/dt, known as the resistance slope, and is the only parameter truly representative of alumina depletion or enrichment in the bath. As an example, if the alumina feed to bath is temporarily lean compared with the theoretical consumption rate (i.e. in an underfeeding condition), the resistivity ρ will be seen to increase in accordance with a known relationship as the alumina content of the bath decreases, while in the same time the AMD practically has not varied, because it changes much more slowly.

The process according to EP 044,794 is based on adjustment of these 2 parameters R and dR/dt, and it can be summarized as follows: starting from a phase in which the alumina is underfed to the bath, a changeover to an overfeed phase for a predetermined time T is commanded if the resistance R exceeds the upper limit Ro+r, where Ro is the setpoint resistance, and if the resistance slope P is larger than a setpoint slope Po.

Conversely, if the slope P remains smaller than the setpoint slope Po, thus indicating sufficient alumina content in the bath, the underfeed condition of the bath is maintained, but a command to lower the anode frame (a "pot squeeze" command) is transmitted if necessary in order to shorten the AMD and thus reduce R to bring it within the setpoint range Ro±r.

Finally, starting from the overfeed phase of duration T, a changeover is made to an underfeed rate at the end of this time T and, if R has become smaller than the lower limit Ro−r of the setpoint range, a command to raise the anode frame (a "pot unsqueeze" command) is transmitted in order to lengthen the AMD and to bring R into the setpoint range Ro±r.

A new cycle is then begun.

This control method therefore permits the alumina content of the bath to be maintained within a narrow and low range and thus Faraday efficiencies on the order of 95% to be obtained with acid baths, while at the same time greatly reducing the so-called "anode effect rate", or in other words the quantity (or frequency) of anode effects on the cells as measured by number of anode effects per cell per day (AE/cell/day).

In cells of older generations with side break, the anode effect rate was higher than 2 or even 3 AE/cell/day, whereas on more modern cells with point feed system this rate is between 0.2 and 0.5 AE/cell/day. At this stage the energy overconsumption and the loss of Faraday efficiency related to anode effects are small, and until the last few years this performance level had been regarded as adequate.

Recently, however, the development of very-high-current electrolysis cells and the quest for even better performances, especially with regard to Faraday efficiency and to energy efficiency, together with the concern about pollution problems due to the fluorocarbon compounds (CFx), especially carbon tetrafluoride (CF4), which have high potential for absorbing infrared radiation and thus favor the greenhouse effect, is now making a priority issue of reduction or even elimination of anode effects, which generate fluorocarbon gases. In this regard, it is appropriate to recall that the anode effect is a phenomenon of electrolysis of fluoride ions that occurs during a deficiency of oxygen ions in contact with the anodes, in particular because of alumina deficiency. Instead of producing carbon dioxide and carbon monoxide by the normal process, the cell produces fluorocarbon gases which, by virtue of their chemical inertness and great stability, are impossible to trap by standard means.

PROBLEM POSED

The development of a precise process for control of low alumina contents in the electrolysis bath so as to ensure high Faraday efficiency (≧95%) with an anode effect rate smaller than 0.05 AE/cell/day has become an essential objective for:

- construction of new potlines employing very-high-current cells in progressively increasing numbers,
- extension of existing potlines without increasing or even while decreasing gaseous fluorocarbon wastes.

OBJECT OF THE INVENTION

The process according to the invention permits this pollution problem to be solved by lowering the anode effect rate on average to 0.02 AE/cell/day, which is well below the target rate of 0.05 AE/cell/day and even more so below the prior art rates of 0.2 to 0.5 AE/cell/day; and it even improves the Faraday efficiency to better than 95% while doing so. The process of the invention uses the basic alumina-control principle already described in EP 044,794 (U.S. Pat. No. 4,431,491), wherein 2 control parameters, the resistance R and the resistance slope P=dR/dt, compared with setpoint values to initiate a change in alumina feed rate or to transmit a command to move the anode frame in order to correct the anode-metal distance (AMD).

The process according to the invention is nevertheless distinguished clearly from the previously described process by the fact that it employs an operating sequence that is completely different in each control cycle, in particular with:

- determination of the resistance and slope at the end of each control cycle and no longer only when the resistance strays outside the setpoint range,
- initiation of an overfeed phase if the alumina content measured by the resistance slope becomes very low, regardless of the position of the resistance relative to the setpoint range,
- finally, refinement of the methods for determining the resistance R and above all the resistance slope P, as well as use of auxiliary parameters to be explained hereinafter, thus ensuring both high precision and great reliability of the new control process.

It is therefore by virtue of the new operating sequence which takes these different modifications into account within each cycle that the process according to the invention has made it possible to reduce by a factor of 10 on average the anode effect ratio obtained even with some of the most efficient of the prior art processes and to achieve Faraday efficiencies systematically better than 95%.

DESCRIPTION OF THE INVENTION

More precisely, the invention relates to a process for control of the alumina content of the bath in a cell for production of aluminum by electrolysis of alumina dissolved in a molten cryolite-base salt, the said process employing alumina feed at a rate modulated as a function of the value and change of the resistance R of the cell as calculated from the difference of electric potential measured at the cell electrode terminals, phases of alumina underfeeding with introduction of alumina at a slow rate CL (phase 1) being alternated with phases of alumina overfeeding with introduction of alumina at a fast rate CR or ultrafast rate CUR (phase 2) compared with a reference rate or theoretical rate CT corresponding to the mean theoretical rate of alumina consumption of the cell, characterized by control cycles of duration T, comprising the following sequence of operations in each cycle:

A/ At the end of each control cycle i, the mean resistance R(i), the rate of change of resistance or resistance slope P(i) and the rate of change of the resistance slope or curvature C(i) are calculated and a prediction is made of the value of the resistance slope at time t(i+1) or extrapolated slope PX(i)=P(i)+C(i)×T, which is an estimate of the future resistance slope P(i+1) at the end of control cycle i+1;

B/ The value R(i) is compared with a setpoint value Ro, and on this basis there are transmitted the following commands to move the anode frame position: shorten the anode-metal distance (pot squeeze), or lengthen the anode-metal distance (pot unsqueeze).

C/ The alumina feed is controlled as a function of the values of the slope P(i), curvature C(i) and extrapolated slope PX(i), preferably relative to reference setpoints such as Po, Co and PXo, in such a way as to compensate for variations in alumina content by anticipating them.

According to one advantageous embodiment of the invention, control of alumina in stage C/ is effected under the following conditions:

If the alumina feed is in phase 1, the values P(i), C(i) and PX(i) are compared respectively with the reference setpoints Po, Co and PXo:

If P(i)<Po and PX(i)<PXo, phase 1 continues;

If P(i)≧Po or PX(i)≧PXo, a changeover to alumina feed phase 2 takes place:

If C(i)≧Co, phase 2 begins with an ultrafast feed rate for a predetermined or calculated time, which is followed by feed at fast rate for a predetermined or calculated time, the calculation of times being performed as a function of the values calculated at the end of the previously defined control cycle;

If C(i)<Co, the alumina feed changes directly to fast rate for a predetermined time or a time calculated as a function of the values calculated at the end of the previously defined control cycle.

If the alumina feed is in phase 2:

phase 2 continues normally for the predetermined time or the time calculated at the end of the preceding phase 1.

Figure 1:
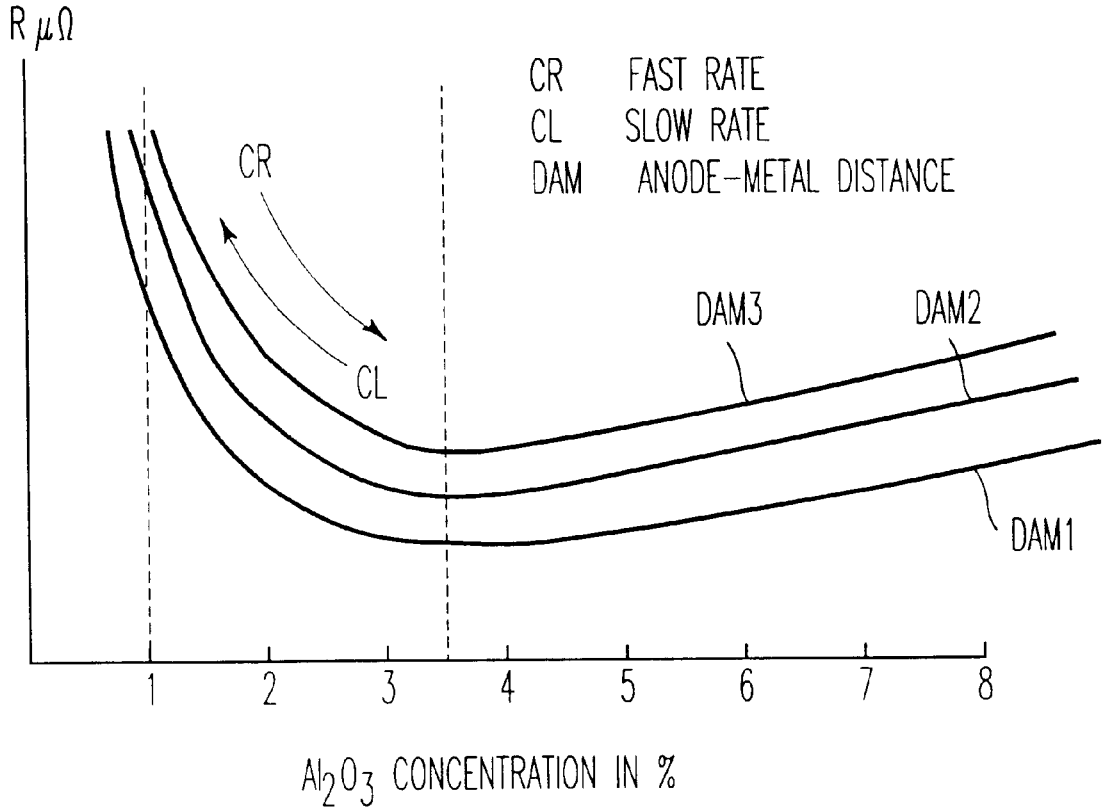
FIG. 1 represents the variation of resistance R at the terminals of an electrolysis cell as a function of the alumina content of the bath at different anode-metal distances.

During development of the new process according to the invention, Applicant was in fact able to observe that a spectacular reduction in anode effect rate could be achieved by changing over to fast feed rate as soon as the resistance slope P became very high, indicating a very low alumina content (1 to 2%) in the bath and a very high risk of development of anode effect, without waiting for the resistance R to stray from the setpoint range, as is the case in the previously described prior art. [FIG. 1, which represents the variation of resistance R at the terminals of an electrolysis cell as a function of alumina content of the bath for different anode-metal distances.] Increasing from $AMD_1$ to $AMD_3$, clearly shows that control of the alumina content of the bath between 1 and 3.5% establishes the best possible conditions, firstly for using acid electrolysis baths at lower temperature and thus guaranteeing excellent Faraday efficiencies, and secondly for detecting the least variation of resistance, since the conditions correspond to the greatest slope of variation of R or in other words to the zone of greatest sensitivity. The corollary of these two advantages implies a quantitatively important capacity to adjust the rate of alumina feed to the bath very rapidly in order to prevent the very large risks—which appear as soon as the alumina content of the bath approaches 1%—of triggering the anode effect.

Figure 2:
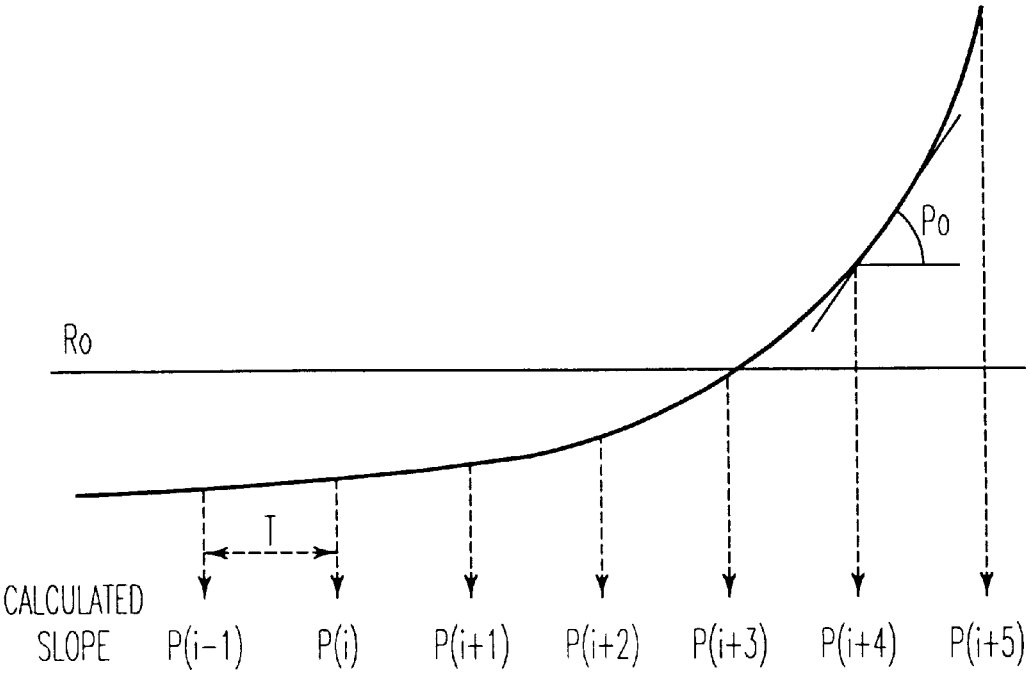
FIG. 2 is a graph of the resistance versus time which indicates that the slope is calculated at regular intervals.

To solve this problem, which was incompletely treated by the closest prior art control process, which did not provide for calculation of the slope value when the resistance R exceeds an upper reference setpoint Ro+r, it proved necessary to perform not only this calculation of the slope at the end of each control cycle but also the calculation of the extrapolated slope predicted for the end of the following cycle, in order to compare these slopes to reference setpoints and immediately to initiate acceleration of the feed rate if necessary and as an anticipatory action in the case of rapid rise in resistance, as shown in the graph of FIG. 2.

This new procedure for control of the alumina content does not preclude employment of concomitant safety procedures.

For example, the control procedure is activated only when the cell is in normal operating conditions (in other words, correctly controlled, stable and free of actions that would perturb operation or control, such as change of anode, tapping of metal or specific control procedures) that authorize changeover to phase 1. If the cell is not in normal operating conditions, the alumina feed rate is at the theoretical value CT or in stand-by phase, until the normal operating conditions for changeover to phase 1 are established.

Furthermore, if feed phase 1 is taking place in the normal course of the control procedure but becomes prolonged beyond a predetermined duration, and if the number of "pot unsqueeze" commands during this phase 1 exceeds a predetermined safety setpoint, it is detected that the bath is too rich in alumina, and so the alumina feed is reduced very drastically or is completely stopped in order to purge the bath of its excess alumina.

Conversely, if the number of "pot squeeze" commands during such a phase 1 exceeds a predetermined safety setpoint, feed phase 2 is initiated regardless of the values of resistance slope and extrapolated slope.

Finally, if the curvature C(i) exceeds a predetermined safety setpoint, alumina feed phase 2 is initiated regardless of the values of resistance slope P(i) and extrapolated slope PX(i).

Furthermore, as regards determination of the control parameters involved in the new control process:

modifications have been made in the methods of calculating the known parameters (R and P), in order to improve process precision additional and new parameters have been employed to improve process reliability as well.

Thus, at the end of each control cycle i of duration T (which lasts between 10 seconds and 15 minutes), at the beginning of which control commands to modify the resistance level are transmitted if necessary, the resistance R(i) is calculated by dividing the control cycle i into n elementary cycles of duration t (lasting between 1 second and 15 minutes), eliminating the first a elementary cycles during which the resistance level is modified by the operations of adjustment of the anode frame position, and calculating the mean R(i) over the last n-a elementary cycles (a<n).

In this case, the mean resistance r(k) of each elementary cycle k of duration t is also calculated at the end of this elementary cycle. To permit calculation of the slope P(i), these values r(k) are stored in memory, retaining the last N values (where N is a predetermined number), throughout the entire feed phase 1.

In fact, the resistance slope P(i), extrapolated slope PX(i) and curvature C(i) determined at the end of each control cycle i of duration T are calculated from the history of the mean resistances r(k) of the elementary cycles stored in memory up to the limit of the last N values since the start of underfeed phase 1, these calculations being performed by any method capable of smoothing the raw data r(k) while eliminating the resistance variations due to commands to adjust the anode frame position. The resistance slope and auxiliary parameters can be calculated by parabolic regression over the resistances or by linear regression over the resistance variations, or by any other method equivalent to nonlinear regression over the resistances.

The method used for calculating the resistance slope P(i) preferably consists of a linear regression over the instantaneous resistance variations or slopes dr(k)=r(k)−r(k−1), this regression being calculated at the end of each elementary cycle k of duration t after elimination of the elementary cycles during which commands to adjust the anode frame position were transmitted. This linear regression over the instantaneous slopes dr(k) is equivalent to a parabolic regression over the resistances r(k) after elimination of the resistance variations due to commands to adjust the anode frame position.

Figure 3:
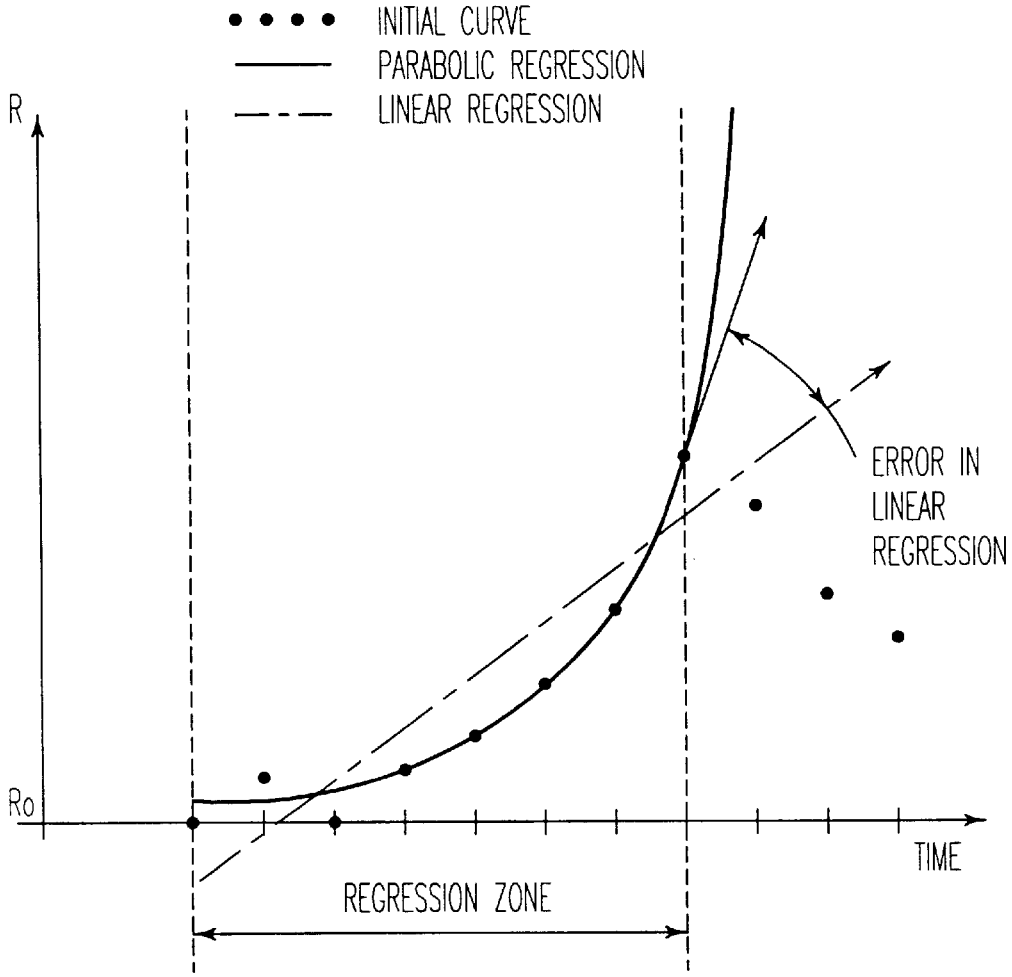
FIG. 3 is a graph of resistance versus time and calculated resistance versus time using linear regression and parabolic regression.

It should in fact be recalled that the resistance varies according to a curve and not to a straight line. According to EP 044,794, the slope is actually calculated by directly constructing a linear regression over the resistance values measured at regular intervals. As shown in the graph of FIG. 3, this necessarily leads to underestimation of the real value of the slope. In addition, this error due to underestimation becomes larger the greater the curvature of the curve of change of R, i.e., the faster the increase of resistance. According to EP 044,794, therefore, when the resistance exceeds the upper reference setpoint Ro+r of the control range, this variation may lead simply to transmission of a "pot squeeze" command to the anode frame and to prolongation of the feed at slow rate, even though the real slope P(i) is actually greater than the reference slope Po and even though an anode effect is then imminent.

The new method used to calculate the slope for application of the present invention is based on the principle of parabolic regression, which permits a much better approximation to the real curve of resistance increase than does a classical linear regression, as illustrated by the diagram of FIG. 3. While Applicant has been prevented by considerations of complexity and of calculation resources beyond the scope of the invention from applying exactly this type of regression to calculate the slope, it nevertheless uses a method related to parabolic regression, consisting of calculating a line of linear regression over the instantaneous slopes, and the value of the resistance slope P(i) corresponds to the ordinate at the instant t(i) of the line of linear regression over the instantaneous slopes.

This new procedure for calculating the slope also yields additional and new items of information, which are used as auxiliary control parameters with a view to optimizing the control of alumina content.

When the line of linear regression over the instantaneous slopes is known, it becomes possible to predict the value of the resistance slope for the cycle i+1 or extrapolated slope PX(i), which corresponds to the ordinate of the regression line extrapolated to the instant t(i+1)=t(i)+T. This value of extrapolated slope PX(i) is employed to detect a rapid rise of the resistance by anticipating it and to decide on whether to change over to the phase of fast feed CR when this extrapolated slope PX(i) becomes larger than an extrapolated reference slope PXo having a value such that PX(i)≧PXo≧Po.

It is also very advantageous to use another auxiliary parameter, the curvature C(i), or in other words the rate of change of the resistance slope P(i) given by the slope of the line of linear regression over the instantaneous slopes, to initiate and modulate the overfeed itself according to the principle that high curvature is a forerunner of an abrupt increase in resistance. Thus an ultrafast feed rate known as "CUR" is initiated when the setpoint value Co is passed. For curvature less than Co, the fast feed rate CR subjected to control by the parameters P(i) and PX(i) is deemed sufficient to lower R(i) and avoid an anode effect.

It must be noted that the reference setpoints Po, PXo and Co may assume different predetermined values or values calculated according to the operating conditions of the cell (bath acidity, temperature, resistance, for example).

By way of indication, for a cell operating at 400,000 amperes (400 kA), the value of the reference slope Po is between 10 and 150 pΩ/s, that of the extrapolated reference slope PXo is between 10 and 200 pΩ/s and that of the reference curvature Co is between 0.010 and 0.200 $p\Omega/s^2$.

All these operating characteristics, which are valid for a cell of current I=400 kA, can be easily transposed to cells of lower current, knowing that the above values of resistance R, slope P and curvature C can be defined as values relative to the current I'<I passing through these cells, such that

R'=R×400/I'

P'=P×400/I'

C'=C×400/I'. The invention will be better understood by reading the detailed description of its application hereinafter.

EXAMPLE OF APPLICATION

The process according to the invention was applied for several months on prototype electrolysis cells with prebaked anodes operated at 400,000 amperes under the following conditions:

The alumina is introduced directly into the molten electrolyte bath in successive doses of constant weight via several inlet orifices, which are kept continuously open by a crust breaker. For this purpose, it will be advantageous to use a point feed device for feeding alumina to the electrolysis cells as described in EP 044,794 (=U.S. Pat. No. 4,431,491) or else in FR 2,527,647 (=U.S. Pat. No. 4,437,964) in the name of Applicant.

The resistance R is calculated every one tenth of one second from measurements of current I and voltage U at the cell electrode terminals according to the following classical relationship:

$$R\,\text{ohm} = \frac{U_{volt} - 1.65}{I_{ampere}}$$

An integrating calculator is used to determine the mean values of the resistances r(k) every 10 seconds or instantaneous resistances r(k) within a control cycle i of duration T=3 minutes, and after elimination, if necessary, of the first values of the control cycle corresponding to the period during which commands to adjust the anode frame position in order to modify the resistance level are transmitted, it calculates the mean resistance R(k) of the cycle and the mean slopes dr(k)=r(k)−r(k−1) for the remaining duration of the cycle and then determines, by linear regression over the values dr(k) stored in memory since the beginning of phase 1 up to a limit of the last N=360 values, the slope P, the extrapolated slope PX and the curvature C=dP/dt. The comparison of the values P, PX and C calculated in this way with the respective reference values then initiates the appropriate commands to the alumina crust breaking and feeding device via the control system. In the present case, these reference values are:

Po=66 p Ω/s

PXo=110 p Ω/s

Co=0.065 p $\Omega/s^2$

The mean hourly alumina consumption for a 400,000-ampere cell is on the order of 230 kg of $Al_2O_3$ per hour, which corresponds to the reference feed rate or theoretical feed rate CT. The following definitions, for example, are made relative to this theoretical rate:

CL slow rate=CT−25%, i.e., 173 kg of $Al_2O_3$ per hour, used in feed phase 1.

CR fast rate=CT+25%, i.e., 288 kg of $Al_2O_3$ per hour,

CUR ultrafast rate=4 CT, i.e., 920 kg of $Al_2O_3$ per hour, used in feed phase 2.

If the cell is under normal operating conditions and the feed is in phase 1, a typical sequence for control of the alumina feed rate is as follows:

a) The following values are found at the end of cycle 1 of duration T=3 minutes
R(i)=5,924 μΩ
P(i)=26 pΩ/s
PX(i)=31 pΩ/s
C(i)=0.028 $p\Omega/s^2$ Feed phase 1 continues.

b) At the end of cycle i+1, since the values of P(i+1) and PX(i+1) are still below the reference setpoints Po=65 pΩ/s and PXo=110 pΩ/s, feed phase 1 continues.

c) The following values are found at the end of cycle i+2:
R(i+2)=5,936 μΩ
P(i+2)=71 pΩ/s
PX(i+2)=75 pΩ/s
C(i+2)=0.022 $p\Omega/s^2$ which initiates the changeover to feed phase 2 at fast speed CR for a duration of 12 minutes (which is calculated by proportion to the slope at the end of the cycle under consideration on the basis of the experimentally defined relationship: duration in minutes=0.083×P(i)+6 rounded to the next highest minute, i.e., in the present case: 0.083×71+6=approximately 12 minutes).

d) Feed phase 2 continues until the start of cycle i+7, at which time feed phase 1 begins again.

e) The following values are found at the end of cycle i+7:
R(i+7)=5,898 μΩ
P(i+7)=7 pΩ/s
PX(i+7)=10 pΩ/s
C(i+7)=0.017 $p\Omega/s^2$ and feed phase 1 continues.

f) At the end of cycle i+8 and i+9, since the values of the slopes P(i+8) and P(i+9) as well as the values of the extrapolated slopes PX(i+8) and PX(i+9) are still below their reference setpoints Po and PXo respectively, feed phase 1 continues.

g) The following values are found at the end of cycle i+10:
R(i+10)=5,917 μΩ
P(i+10)=108 pΩ/s
PX(i+10)=120 pΩ/s
C(i+10)=0.067 $p\Omega/s^2$ and feed phase 2 is initiated with immediate ultrafast feed rate for a predetermined time of 2 minutes (the CUR feed time is generally fixed at a value between 1 and 5 minutes to ensure rapid alumina replenishment in the bath without risking saturation and consequently fouling of the cell). After 2 minutes, feed phase 2 changes over to fast rate for a calculated duration of 15 minutes [0.083×P(i+10)+6 rounded to the next higher minute].

h) At the end of (2+15)=17 minutes, i.e., during cycle i+16, feed phase 1 begins again.

j) At the end of cycle i+16, since the values of P(i+16) and PX(i+16) are still below the reference setpoints Po and PXo, feed phase 1 continues, and more generally control of the alumina concentration in the electrolysis bath also continues according to the rules defined in the foregoing.

The application of the process being defined in this way, after more than 6 months of application in 400,000-ampere prototype cells using a cryolite-base electrolysis bath containing 12% excess AlF3, and therefore of markedly acid character, at a temperature of 950° C., the alumina content has been maintained continuously between 1.5% and 3.5%, with a median value of 2.1%.

During this period, the mean Faraday efficiency was 95.6% and the anode effect ratio was 0.018 AE/cell/day.

We claim:

1. A process for control of the alumina content of the bath in a cell for production of aluminum by electrolysis of alumina dissolved in a molten cryolite-base salt, the said process employing alumina feed at a rate modulated as a function of the value and change of the resistance R of the cell as calculated from the difference of electric potential measured at the cell electrode terminals, phases of alumina underfeeding with introduction of alumina at a slow rate CL (phase 1) being alternated with phases of alumina overfeeding with introduction of alumina at a fast rate CR or ultrafast rate CUR (phase 2) compared with a reference rate or theoretical rate CT corresponding to the mean theoretical rate of alumina consumption of the cell, characterized by control cycles of duration T, comprising the following sequence of operations in each cycle:

A/ At the end of each control cycle i, the mean resistance R(i), the rate of change of resistance or resistance slope P(i) and the rate of change of the resistance slope or curvature C(i) are calculated and a prediction is made of the value of the resistance slope at time t(i+1) or extrapolated slope PX(i)=P(i)+C(i)×T, which is an estimate of the future resistance slope P(i+1) at the end of control cycle i+1;

B/ The value R(i) is compared with a setpoint value Ro, and on this basis there are transmitted the following commands to move the anode frame position: shorten the anode-metal distance (pot squeeze), or lengthen the anode-metal distance (pot unsqueeze);

C/ The alumina feed is controlled as a function of the values of the slope P(i), curvature C(i) and extrapolated slope PX(i) in order to compensate for variations in alumina content by anticipating them.

2. A control process according to claim 1, characterized in that the alumina feed in stage C/ is controlled as a function of the values of slope P(i), curvature C(i) and extrapolated slope PX(i) relative to reference setpoints Po, Co and PXo.

3. A control process according to claim 2, characterized in that the reference setpoints Po, PXo and Co may assume different predetermined values or values calculated according to the operating conditions of the cell.

4. A control process according to claim 2, characterized in that, for a cell operating at 400 kA, the reference slope Po is fixed between 10 and 150 pΩ/s, the extrapolated reference slope PXo is fixed between 10 and 200 pΩ/s and the reference curvature Co is fixed between 0.010 and 0.200 $p\Omega/s^2$.

5. A control process according to claim 1, characterized in that the alumina feed in stage C/ is controlled under the following conditions:

If the alumina feed is in phase 1, the values P(i), C(i) and PX(i) are compared respectively with the reference setpoints Po, Co and PXo:

If P(i)<Po and PX(i)<PXo, phase 1 continues;

If P(i)≧Po or PX(i)≧PXo, a changeover to alumina feed phase 2 takes place:

If C(i)≧Co, phase 2 begins with an ultrafast feed rate for a predetermined or calculated time, which is followed by feed at fast rate for a predetermined or calculated time, the calculation of times being performed as a function of the values calculated at the end of the previously defined control cycle;

If C(i)<Co, the alumina feed changes directly to fast rate for a predetermined time or a time calculated as a function of the values calculated at the end of the previously defined control cycle;

If the alumina feed is in phase 2:

phase 2 continues normally for the predetermined time or the time calculated at the end of the preceding phase 1.

6. A control process according to claim 5, characterized in that the reference setpoints Po, PXo and Co may assume different predetermined values or values calculated according to the operating conditions of the cell.

7. A control process according to claim 5, characterized in that, for a cell operating at 400 kA, the reference slope Po is fixed between 10 and 150 pΩ/s, the extrapolated reference slope PXo is fixed between 10 and 200 pΩ/s and the reference curvature Co is fixed between 0.010 and 0.200 $p\Omega/s^2$.

8. A control process according to claim 1, characterized in that the control procedure is authorized only when the cell is in normal operating conditions, or in other words is correctly controlled, stable and free of actions that would perturb operation or control, such as change of anode, tapping of metal or specific control procedures, and in that the control procedure begins with a phase 1 of alumina underfeeding.

9. A control process according to claim 1, characterized in that, at the end of alumina feed phase 2, the cell returns to phase 1, provided the cell is in normal operating conditions.

10. A control process according to claim 1, characterized in that, at the end of phase 2, the alumina feed changes over to theoretical rate or to stand-by phase if the cell is not in normal operating conditions, then resumes phase 1 as soon as the cell has recovered normal operating conditions.

11. A control process according to claim 1, characterized in that, if the duration of phase 1 exceeds a predetermined time, and if the number of "pot unsqueeze" commands during this phase 1 exceeds a predetermined[]safety setpoint, it is detected that the bath is too rich in alumina, and so the alumina feed is reduced very drastically or is completely stopped in order to purge the bath of its excess alumina.

12. A control process according to claim 1, characterized in that, if the number of "pot squeeze" commands during such a phase 1 exceeds a predetermined safety setpoint, alumina feed phase 2 is initiated regardless of the values of resistance slope and extrapolated slope.

13. A control process according to claim 1, characterized in that, if the curvature exceeds a predetermined safety setpoint, alumina feed phase 2 is initiated regardless of the values of resistance slope and extrapolated slope.

14. A control process according to claim 1, characterized in that each control cycle i of duration T between 10 seconds and 15 minutes is divided into n elementary cycles k of duration t between 1 second and 15 minutes.

15. A control process according to claim 1, characterized in that the resistance R(i) calculated at the end of each control cycle of duration T is the mean resistance over the last n-a elementary cycles of the control cycle, i.e., the first a elementary cycles of the control cycle during which the control system can transmit commands to adjust the anode frame position to modify the resistance level are eliminated.

16. A control process according to claim 15, characterized in that the mean resistance r(k) of the elementary cycle is calculated at the end of each elementary cycle k of duration t, and in that the successive values r(k) are stored in memory.

17. A process according to claim 16, characterized in that the values r(k) are stored in memory during phase 1, subject to a limit of the last N values.

18. A control process according to claim 16, characterized in that the resistance slope P(i), extrapolated slope PX(i) and curvature C(i) determined at the end of each control cycle i of duration T are calculated from the history of the mean resistances r(k) of the elementary cycles by any method capable of smoothing the raw data r(k) while eliminating the resistance variations due to commands to adjust the anode frame position.

19. A control process according to claim 18, characterized in that the method used for calculating the resistance slope P(i) and the auxiliary parameters consists of a linear regression over the instantaneous slopes dr(k)=r(k)−r(k−1) after elimination of the cycles during which commands to adjust the anode frame position were transmitted.

20. A control process according to claim 1, characterized in that the resistance slope P(i) and auxiliary parameters PX(i) and C(i) are calculated by parabolic regression over the resistances or by linear regression over the resistance variations, or by any other method equivalent to nonlinear regression over the resistances.

21. A control process according to claim 1, characterized in that the value of the resistance slope P(i) corresponds to the ordinate at the instant t(i) of the line of linear regression over the instantaneous slopes.

22. A control process according to claim 1, characterized in that the predicted value of the resistance slope for the cycle i+1 or extrapolated slope PX(i) corresponds to the ordinate of the regression line extrapolated to the instant t(i+1)=t(i)+T.

23. A control process according to claim 1, characterized in that the value of the curvature C(i) is given by the slope of the line of linear regression over the instantaneous slopes.

24. A control process according to claim 1, characterized in that the operating characteristics of resistance R, resistance slope P, extrapolated slope PX and curvature C, which are valid for a cell of current l=400 kA, can be transposed to cells of Dower or higher current l', according to the relationships:

$R'=P\times 400/l'$ $P'=P\times 400/l'$ $PX'=PX\times 400/l'$and $C'=C\times 400/l'$.

* * * * *

UNITED STATES PATENT AND TRADEMARK OFFICE

CERTIFICATE OF CORRECTION

PATENT NO. : 6,033,550

DATED : March 7, 2000

INVENTOR(S): Olivier BONNARDEL et al.

It is certified that an error appears in the above-identified patent and that said Letters Patent is hereby corrected as shown below:

On the title page, item [75], the 2nd Inventor's country is erroneously listed. It should read as follows:

--[75] Inventors: Olivier Bonnardel, St. Martin D'Arc, France; Pierre Marcellin, Manaba, Bahrain--

Signed and Sealed this

Tenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,033,550
DATED : March 7, 2000
INVENTOR(S) : Olivier Bonnardel et al.

It is certified that error appears in the above-identified patent and that said Letters Patent is hereby corrected as shown below:

Column 5,
Line 50, "[FIG. 1," should read -- FIG. 1, --;
Line 53, "distances.] Increasing" should read -- distances increasing --.

Column 11,
Line 47, "predetermined[]safety" should read -- predetermined safety --.

Column 12,
Line 54, "Dower" should read -- lower --;
Line 56, "R'=Px400/1' " should read -- R'=Rx400/1' --.

Signed and Sealed this

Third Day of December, 2002

JAMES E. ROGAN
*Director of the United States Patent and Trademark Office*